US008434592B1

(12) United States Patent
Young

(10) Patent No.: US 8,434,592 B1
(45) Date of Patent: May 7, 2013

(54) MOBILE TOWER DRIVE SYSTEM

(75) Inventor: Roland O. Young, Grand Forks, ND (US)

(73) Assignee: Telpro, Inc., Grand Forks, ND (US)

( * ) Notice: Subject to any disclaimer, the term of this patent is extended or adjusted under 35 U.S.C. 154(b) by 260 days.

(21) Appl. No.: 12/942,504

(22) Filed: Nov. 9, 2010

(51) Int. Cl.
*E04G 3/28* (2006.01)

(52) U.S. Cl.
USPC ..... 182/12; 182/13; 182/16; 182/19

(58) Field of Classification Search ..... 182/12, 182/13, 16, 19
See application file for complete search history.

(56) References Cited

U.S. PATENT DOCUMENTS

| | | | | | |
|---|---|---|---|---|---|
| 2,573,575 | A * | 10/1951 | Keroson | 182/14 |
| 3,095,945 | A * | 7/1963 | Mitchell | 182/14 |
| 3,180,450 | A * | 4/1965 | Crager et al. | 182/14 |
| 3,232,375 | A * | 2/1966 | Warthen | 182/13 |
| 3,520,382 | A * | 7/1970 | Halsey et al. | 182/13 |
| 3,817,346 | A * | 6/1974 | Wehmeyer | 182/14 |
| 3,865,203 | A * | 2/1975 | Hibma | 180/2.1 |
| 3,930,548 | A * | 1/1976 | Wallraff | 180/6.5 |
| 3,961,681 | A * | 6/1976 | Fisher | 180/305 |
| 4,053,025 | A * | 10/1977 | Slusarenko | 180/2.1 |
| 4,088,202 | A * | 5/1978 | Costello | 182/13 |
| 4,275,797 | A * | 6/1981 | Johnson | 180/65.1 |
| 4,475,611 | A * | 10/1984 | Fisher | 180/6.5 |
| 4,662,476 | A * | 5/1987 | Ross | 182/13 |
| 5,722,506 | A * | 3/1998 | Takai | 182/16 |
| 6,039,148 | A * | 3/2000 | Riegel | 182/16 |
| 6,109,390 | A * | 8/2000 | Giannopoulos | 182/16 |
| 6,283,249 | B1 * | 9/2001 | Young et al. | 182/17 |
| 6,431,314 | B1 * | 8/2002 | Boulanger et al. | 182/63.1 |
| 6,533,067 | B2 * | 3/2003 | Chick | 182/16 |
| 6,786,299 | B2 * | 9/2004 | Bennett | 182/13 |
| 6,880,672 | B2 * | 4/2005 | Imberi | 182/13 |
| 7,004,284 | B2 * | 2/2006 | Chick | 182/16 |

OTHER PUBLICATIONS http://www.markchick.com/site/crawler/crawler_features.htm; Mark Chick; St. Louis, MO.

* cited by examiner

*Primary Examiner* — Alvin Chin Shue
*Assistant Examiner* — Colleen M Chavchavadze
(74) *Attorney, Agent, or Firm* — Neustel Law Offices

(57) ABSTRACT

A mobile tower drive system for efficiently attaching a removable drive system to a scaffolding unit and driving the scaffolding unit from the work platform. The mobile tower drive system generally includes a lower unit adapted to be secured to a lower end of a scaffolding unit, wherein the lower unit has a wheel to operably engage a floor surface and move between an engaged and disengaged position. The lower unit removably attaches to an upper unit, wherein the upper unit is secured relative the upper frame of the scaffolding unit. Both, the lower unit and the upper unit employ coaxial drives for turning and driving the wheel. The coaxial drive also is used to brake the wheel. The coaxial drives are generally controlled via manually operable rotational control levers; however automated power sources may be utilized. Also disclosed are swivel locks for the caster wheels of the scaffolding unit.

19 Claims, 15 Drawing Sheets

MOBILE TOWER DRIVE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a drive mechanism and more specifically it relates to a mobile tower drive system for efficiently attaching a removable drive system to a scaffolding unit and driving the scaffolding unit from the work platform.

2. Description of the Related Art

Any discussion of the related art throughout the specification should in no way be considered as an admission that such related art is widely known or forms part of common general knowledge in the field.

Scaffolding units have been in use for years and are utilized to access structures or objects of various heights above the floor surface. It is generally necessary, when using a scaffolding unit, to move the scaffolding unit from time-to-time to access different areas. Various methods have been utilized to move the scaffolding unit.

One method is to use an automated drive system built into the scaffolding unit. A problem with these units are that the automated or powered built-in control typically drastically increases the cost of the scaffolding unit as well as the size of the scaffolding unit which may be disadvantageous for smaller applications.

Another method of moving the scaffolding is to physically climb down the scaffolding each time it is desired to move the scaffolding. For obvious reasons, this method can be tedious and tiresome. Because of the inherent problems with the related art, there is a need for a new and improved mobile tower drive system for efficiently attaching a removable drive system to a scaffolding unit and driving the scaffolding unit from the work platform.

BRIEF SUMMARY OF THE INVENTION

A system for efficiently attaching a removable drive system to a scaffolding unit and driving the scaffolding unit from the work platform. The invention generally relates to a drive mechanism which includes a lower unit adapted to be secured to a lower end of a scaffolding unit, wherein the lower unit has a wheel to operably engage a floor surface and move between an engaged and disengaged position. The lower unit removably attaches to an upper unit, wherein the upper unit is secured relative the upper frame of the scaffolding unit. Both, the lower unit and the upper unit employ coaxial drives for turning and driving the wheel. The coaxial drive also is used to brake the wheel. The coaxial drives are generally controlled via manually operable rotational control levers; however automated power sources may be utilized. Also disclosed are swivel locks for the caster wheels of the scaffolding unit.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview.

Figure 1:
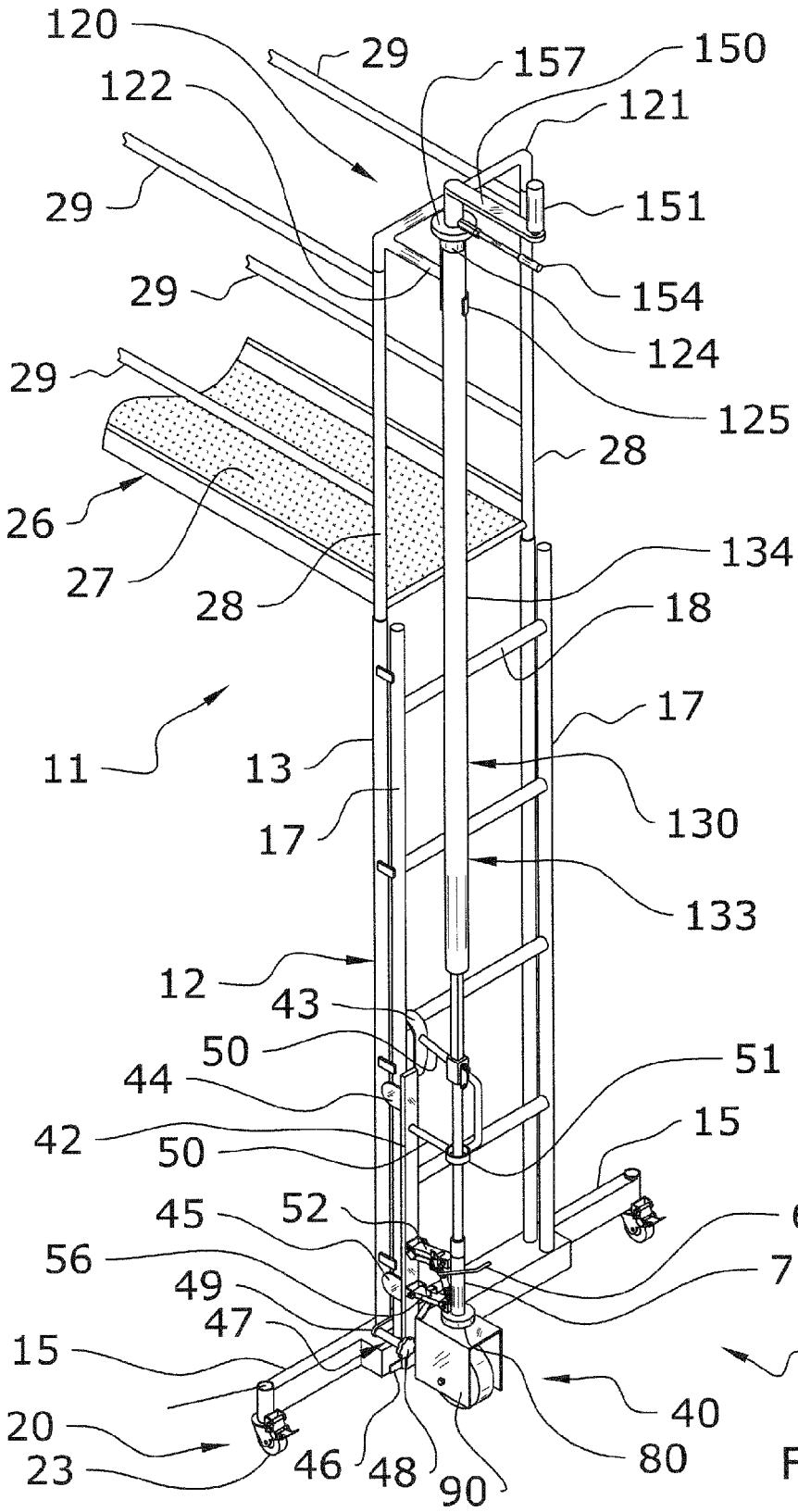
FIG. 1 is an upper perspective view of the present invention connected to a scaffolding unit.
Figure 2:
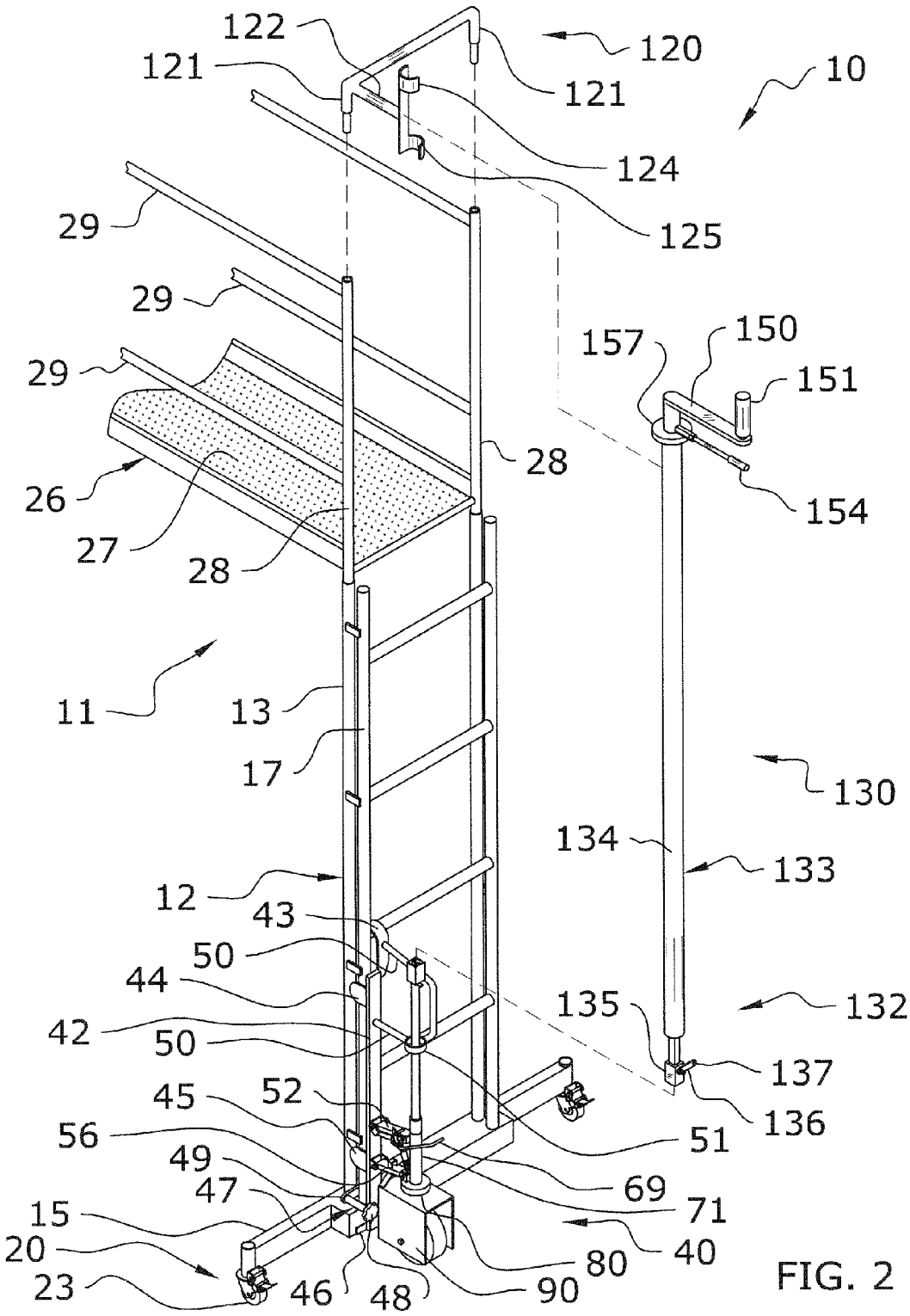
FIG. 2 is an upper perspective view of the present invention, with the lower unit connected to a scaffolding unit and the upper unit exploded from the lower unit and the upper retainer.
Figure 3:
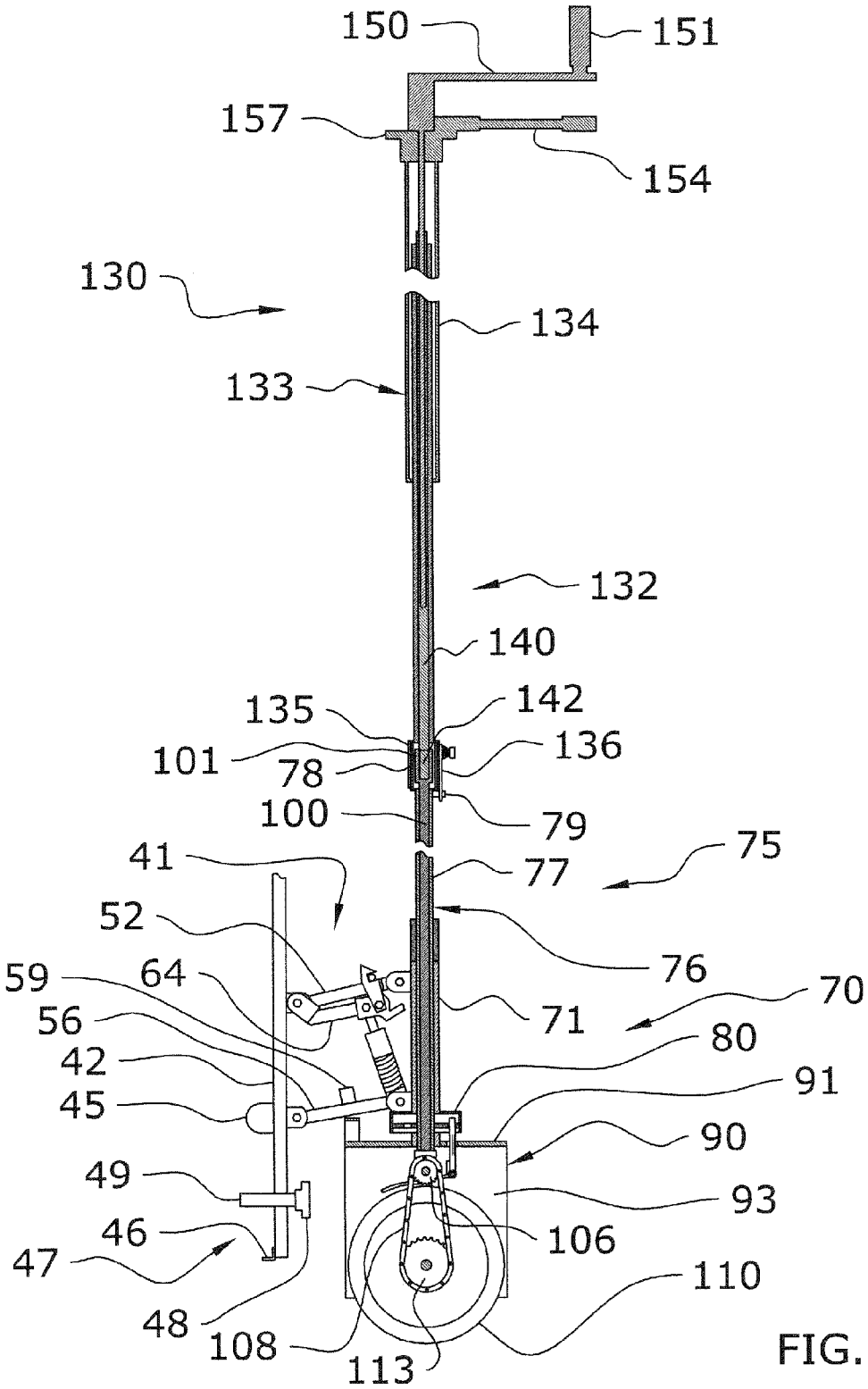
FIG. 3 is a side sectional view illustrating the lower coaxial drive of the lower unit connected to the upper coaxial drive of the upper unit.
Figure 4:
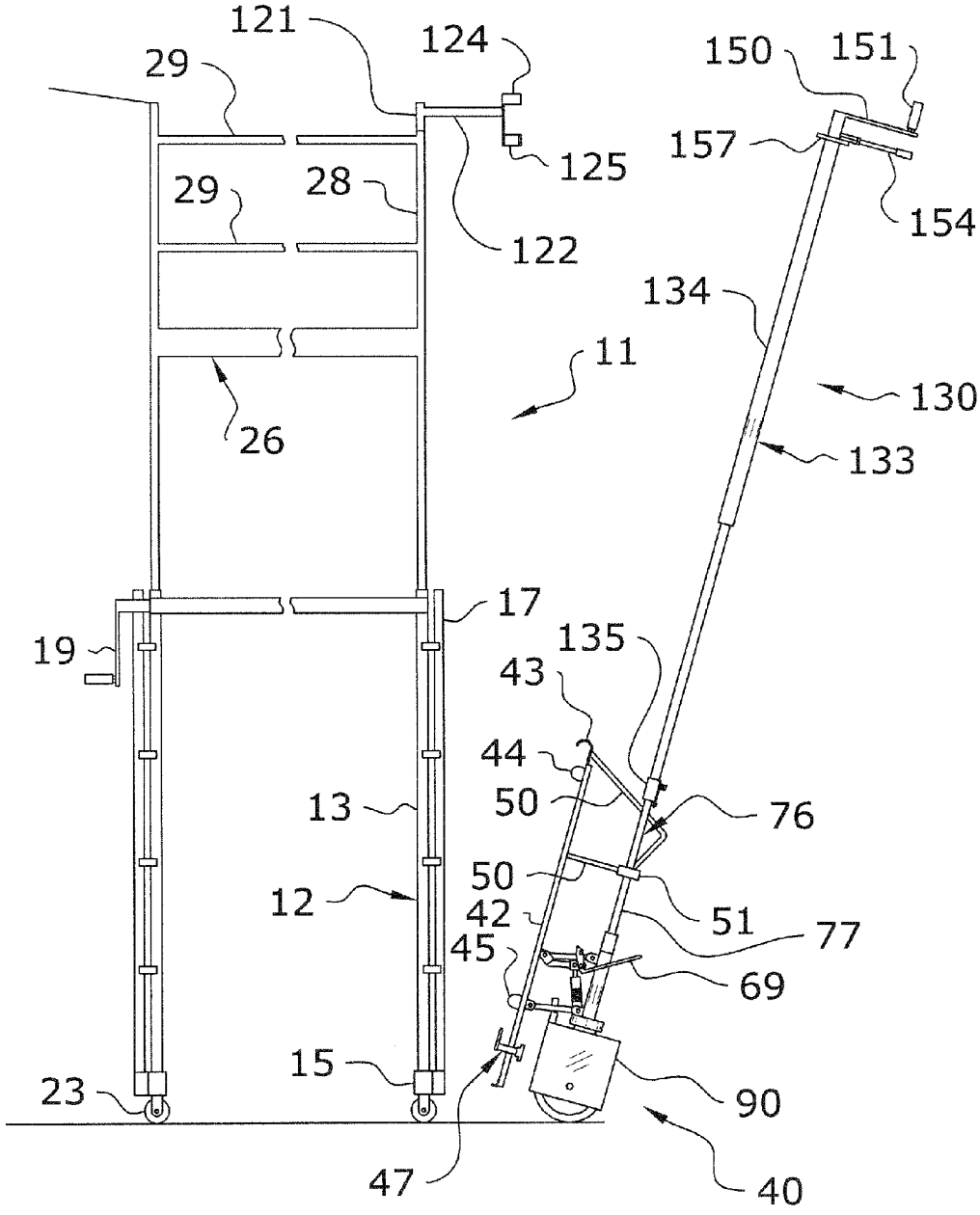
FIG. 4 is a side view of the present invention being connected to a scaffolding unit.
Figure 5:
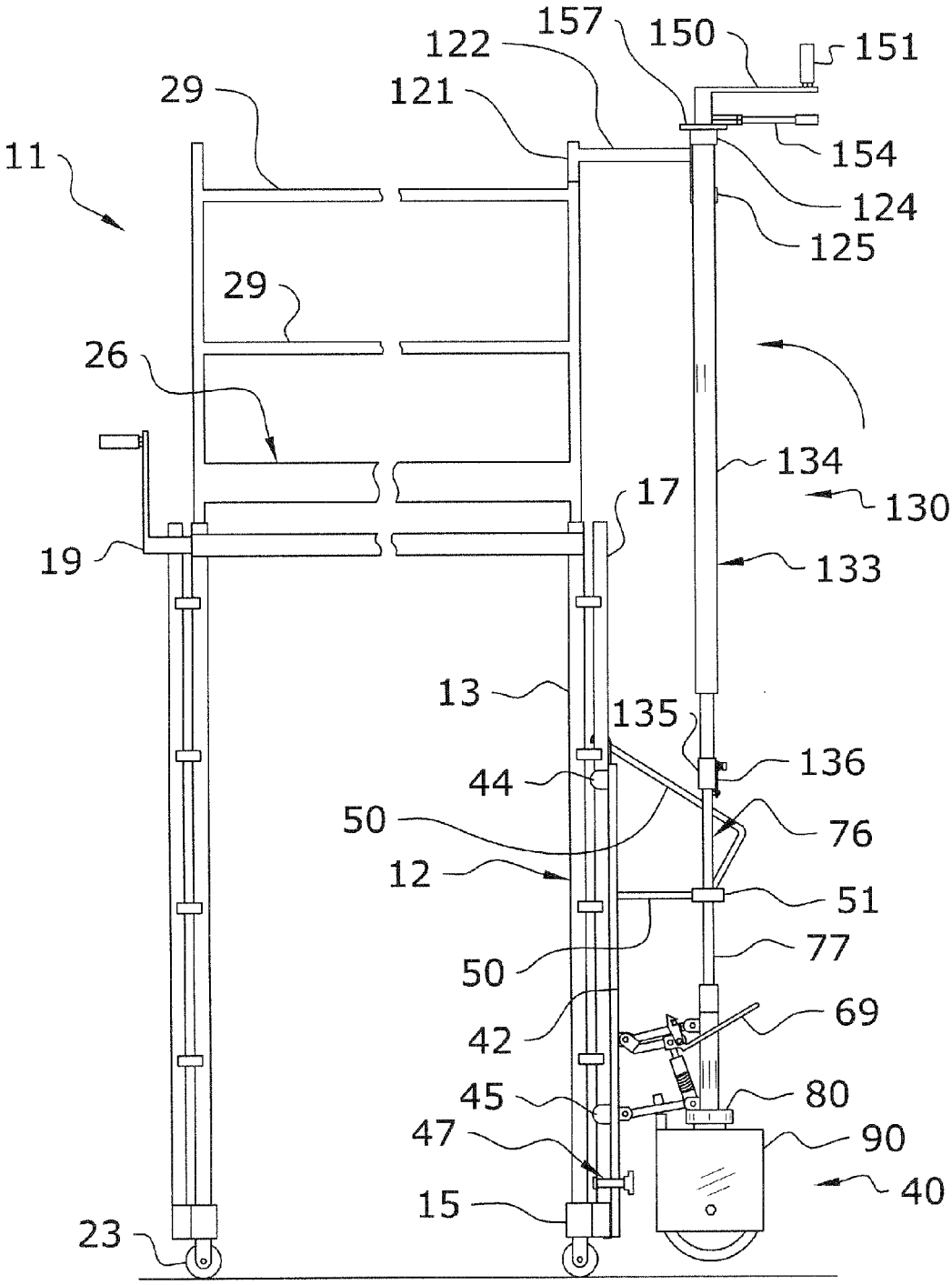
FIG. 5 is a side view of the present invention connected to a scaffolding unit with the drive assembly in the disengaged position.
Figure 6:
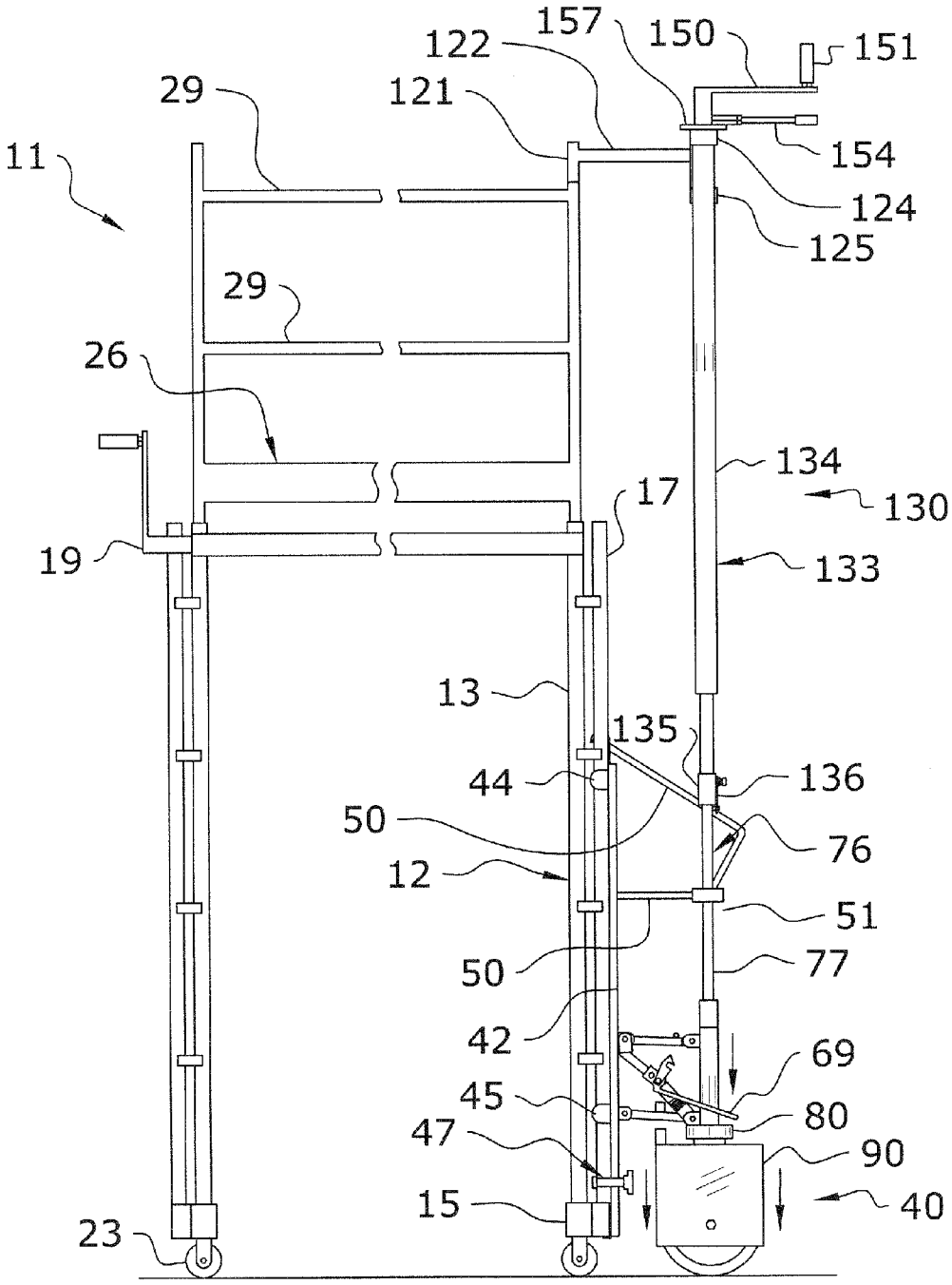
FIG. 6 is a side view of the present invention connected to a scaffolding unit with the drive assembly in the engaged position.
Figure 7:
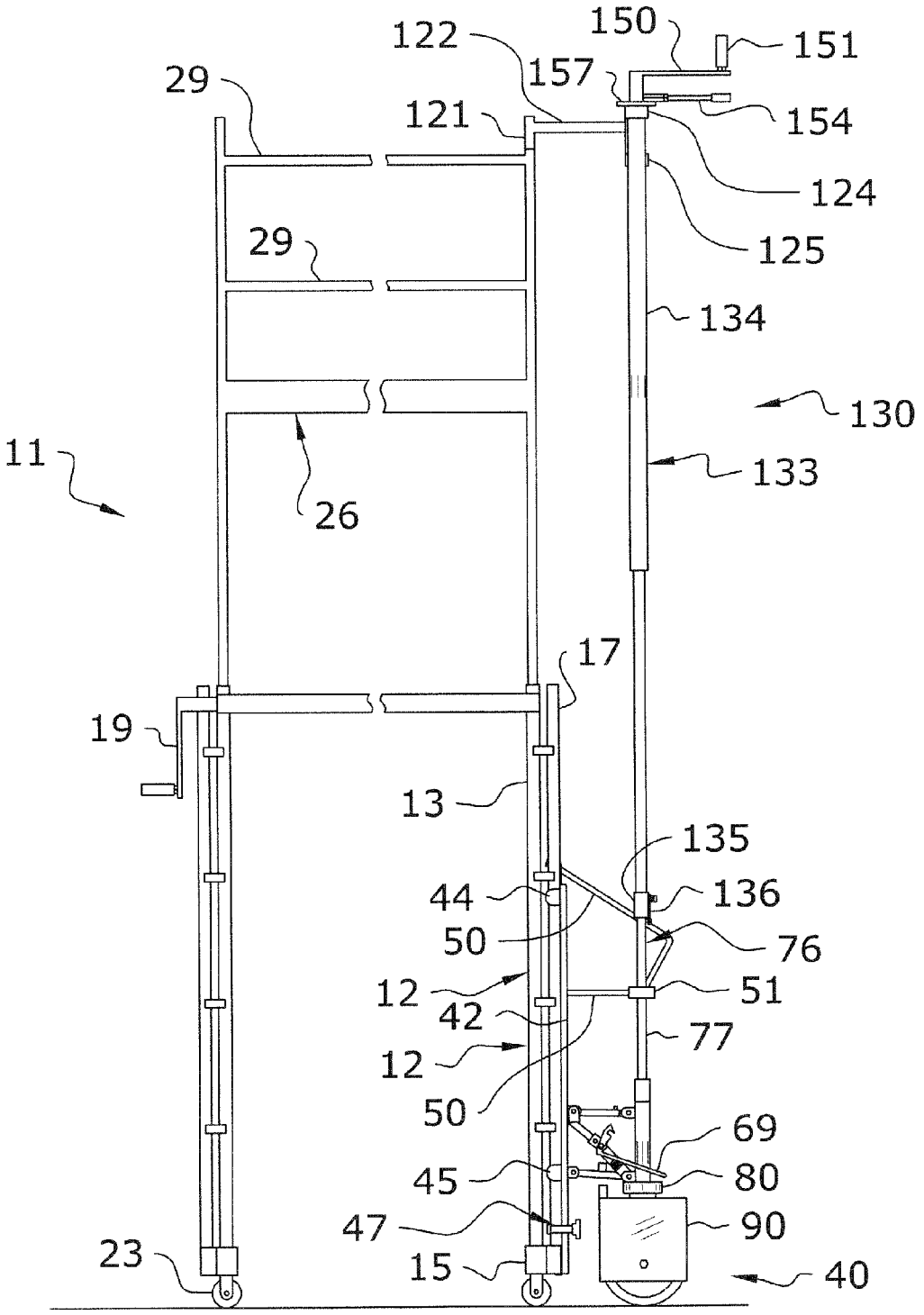
FIG. 7 is a side view of the present invention connected to a scaffolding unit with the drive assembly in the engaged position and illustrating the upper frame of the scaffolding unit being raised thus causing the upper unit to freely raise.
Figure 8:
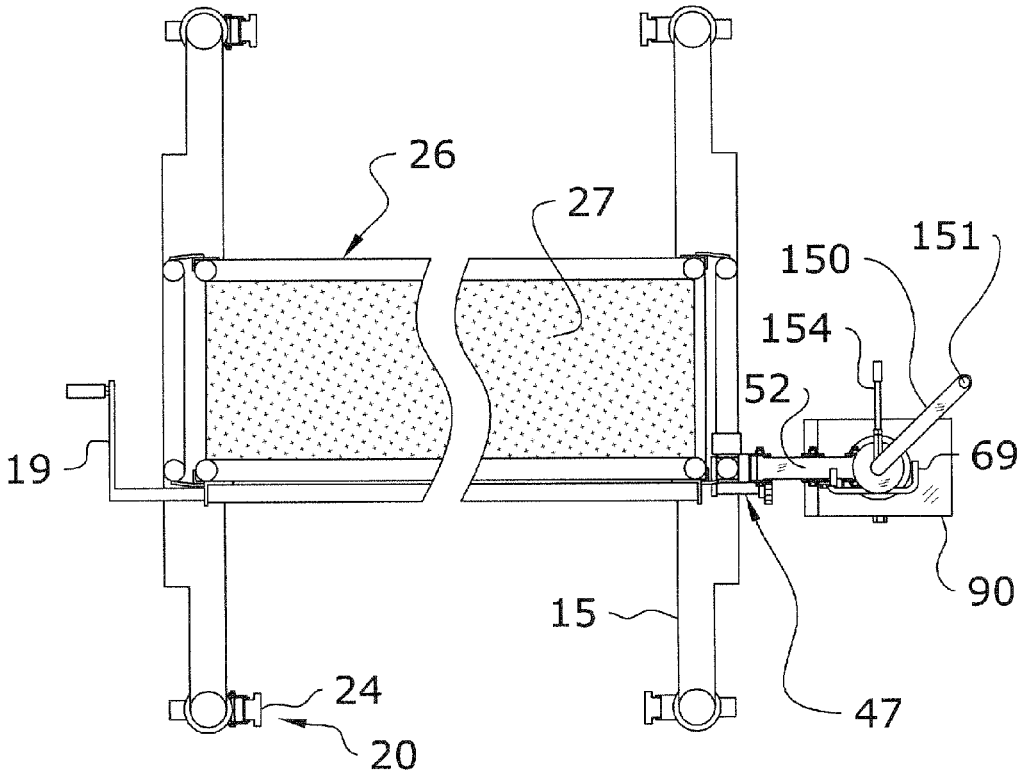
FIG. 8 is a top view of the present invention connected to a scaffolding unit
Figure 9:
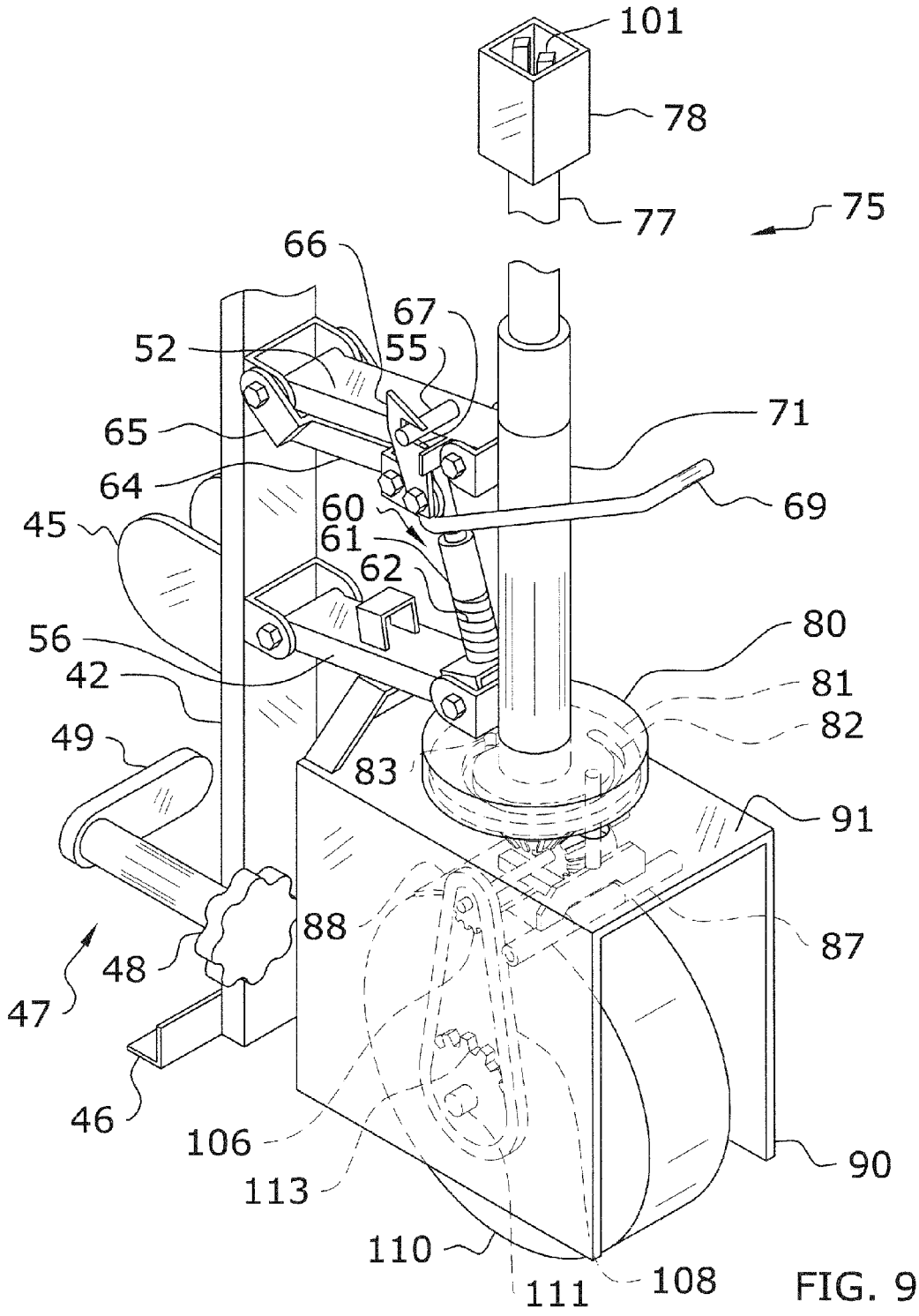
FIG. 9 is a zoomed upper perspective view of the lower unit illustrating the drive components enclosed by the shroud.
Figure 10:
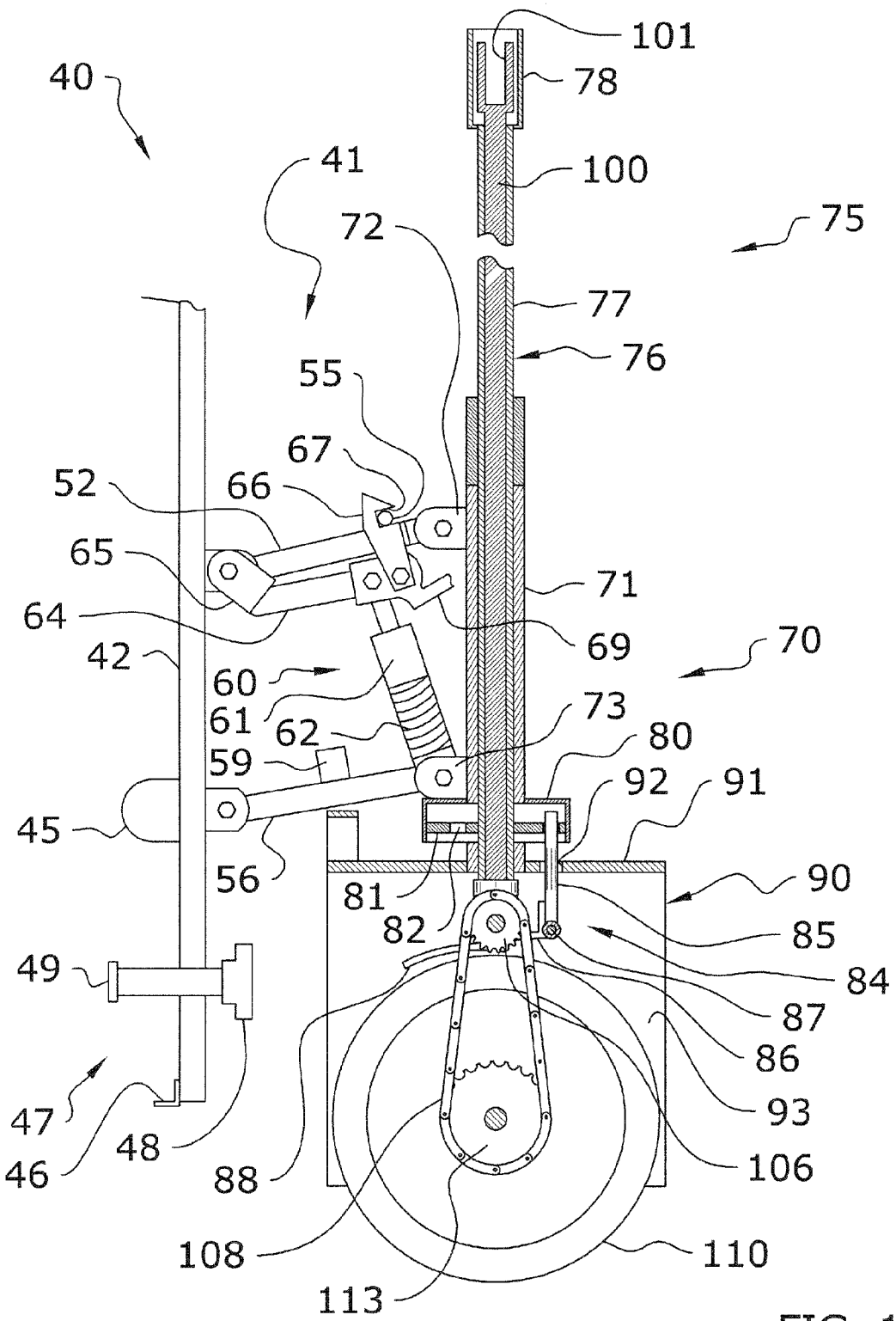
FIG. 10 is a side sectional view of the lower unit illustrating the brake unit in a disengaged position.
Figure 11:
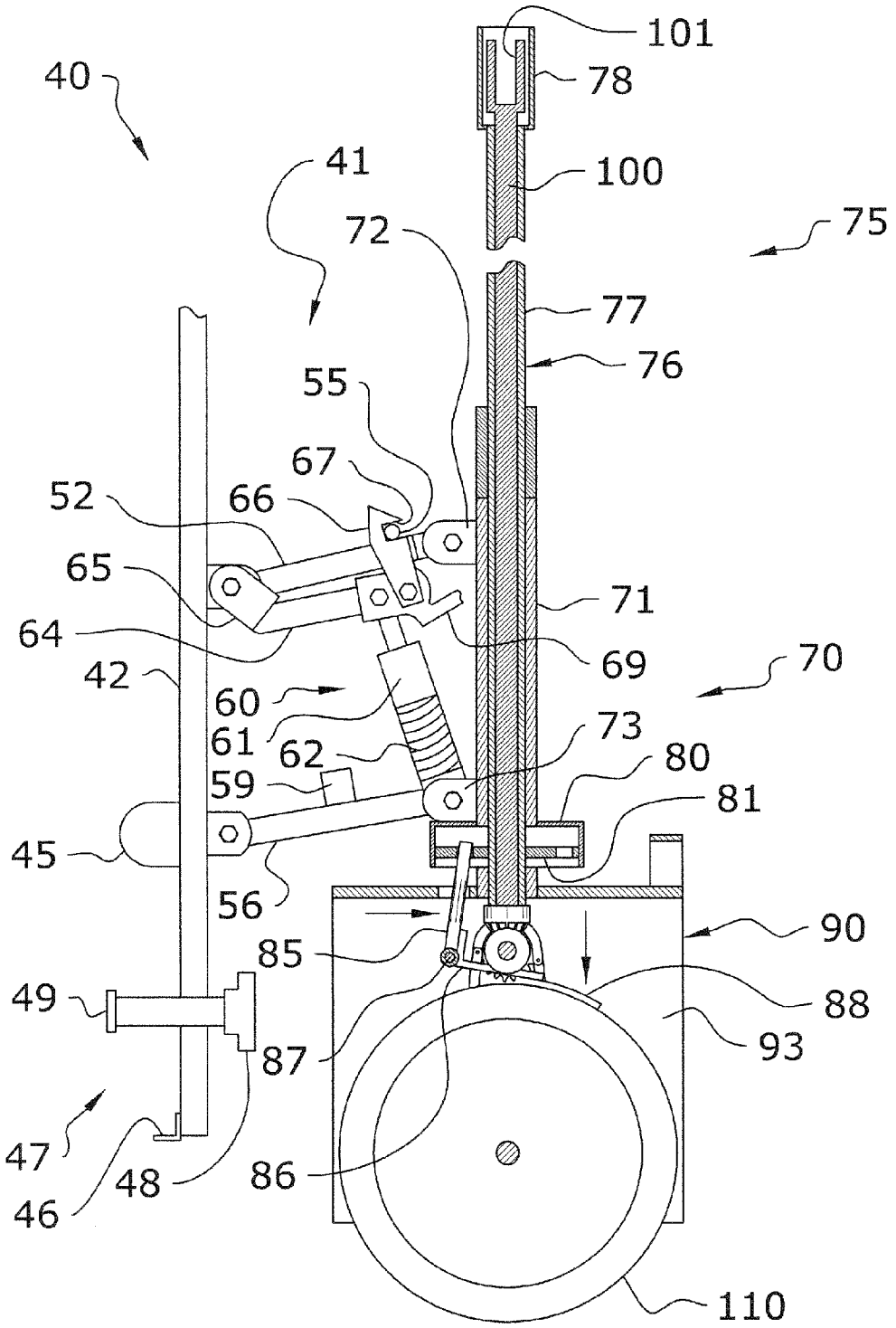
FIG. 11 is a side sectional view of the lower unit illustrating the brake unit in an engaged position.
Figure 12:
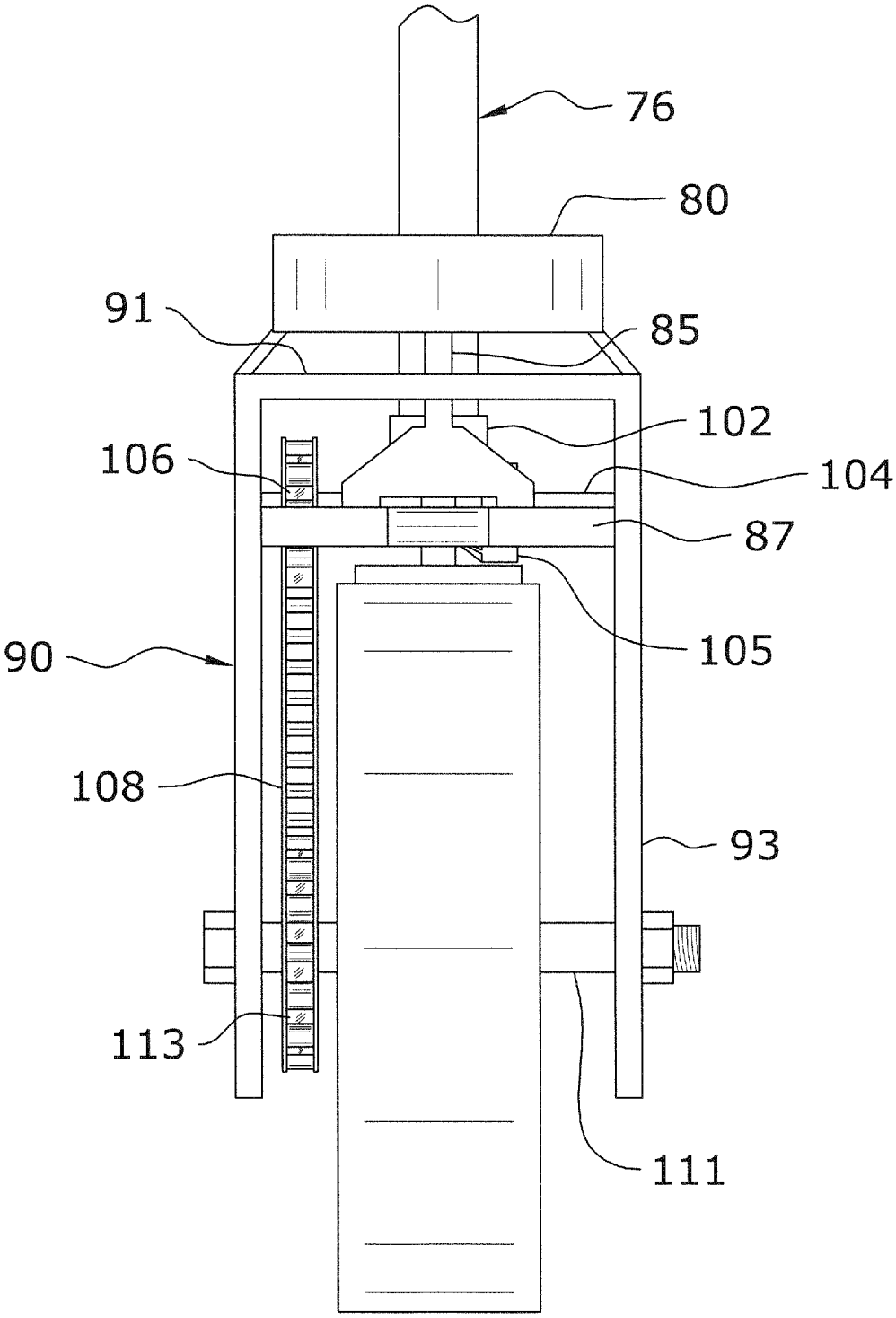
FIG. 12 is a front view of the drive components enclosed by the shroud.
Figure 13:
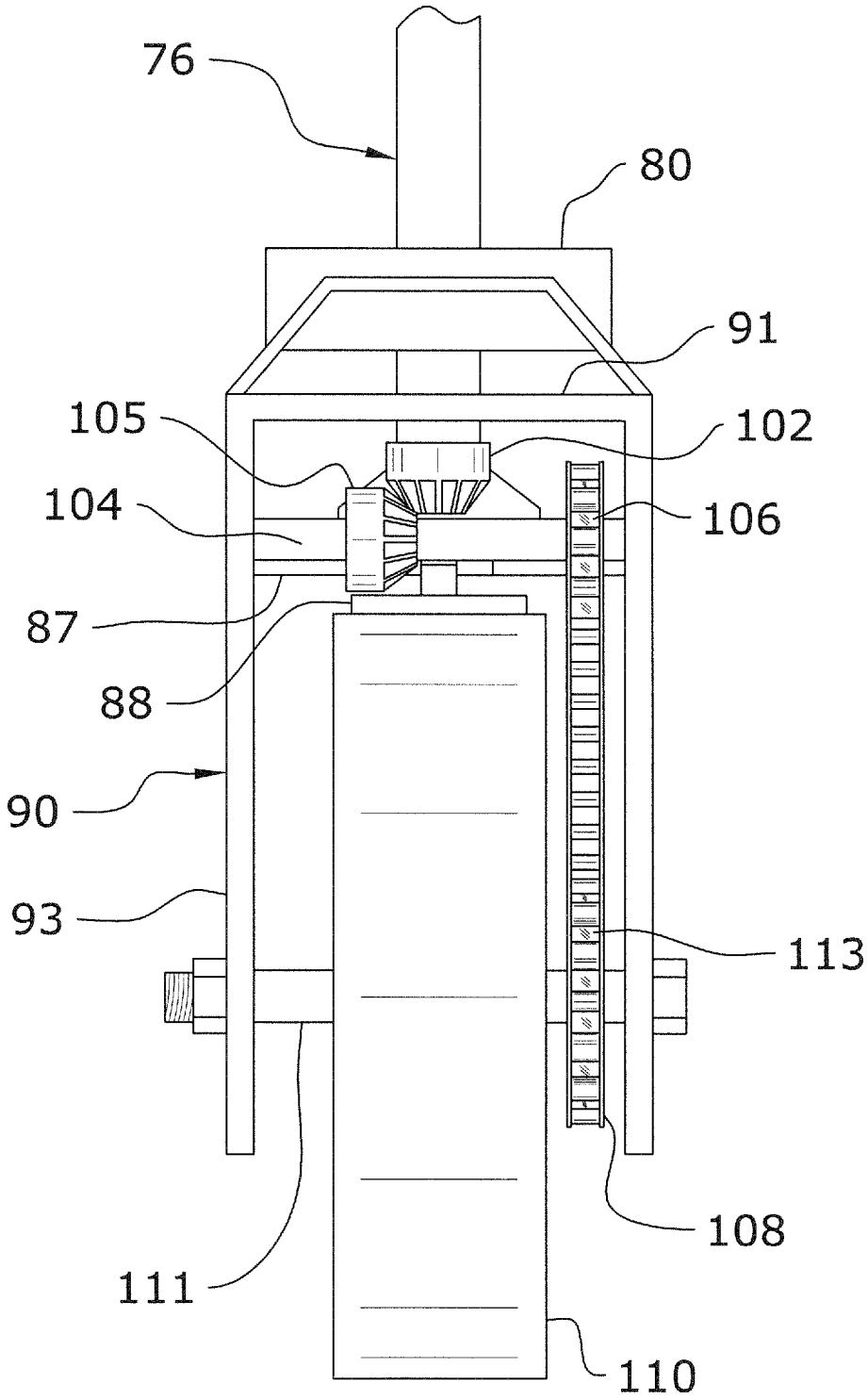
FIG. 13 is a rear view of the drive components enclosed by the shroud.
Figure 14:
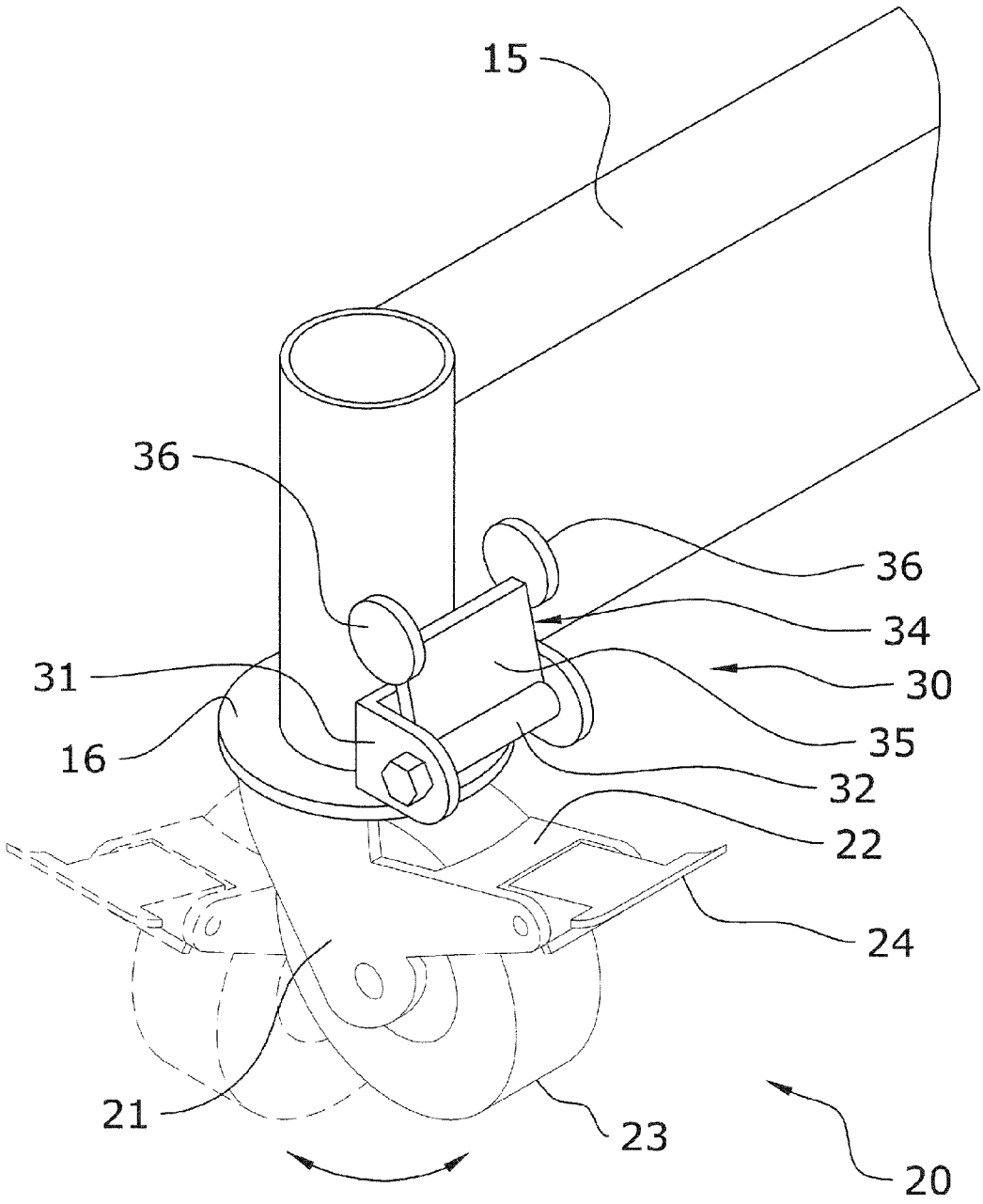
FIG. 14 is an upper perspective view of a first embodiment of the swivel lock.
Figure 15:
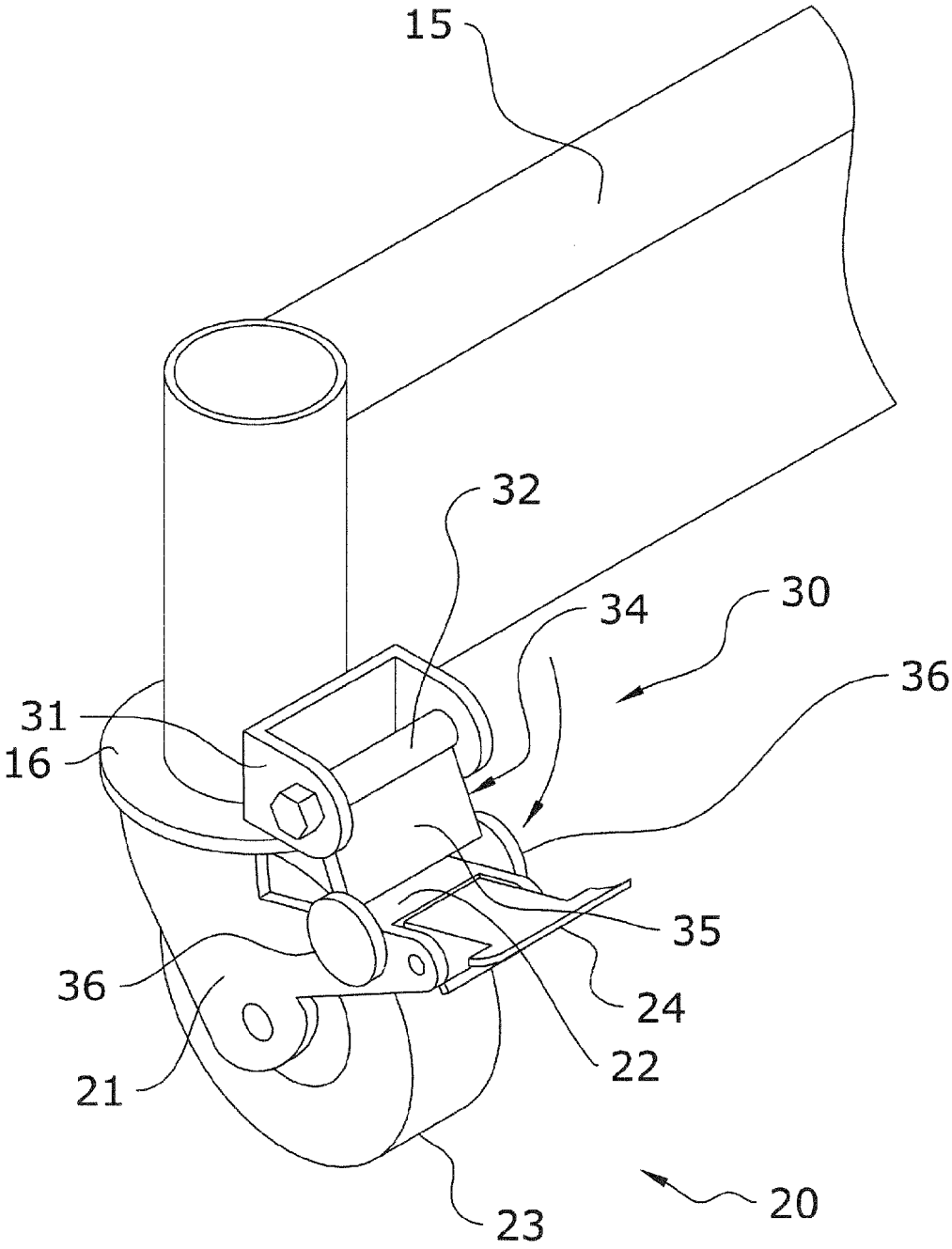
FIG. 15 is an upper perspective view of a first embodiment of the swivel lock.

Turning now descriptively to the drawings, in which similar reference characters denote similar elements throughout the several views, FIGS. 1 through 15 illustrate a mobile tower drive system 10, which comprises a lower unit 40 adapted to be secured to a lower frame 12 of a scaffolding unit 11, wherein the lower unit 40 has a wheel 110 to operably engage a floor surface and move between an engaged and disengaged position. The lower unit 40 removably attaches to an upper unit 130, wherein the upper unit 130 is secured relative the upper frame 26 of the scaffolding unit 11. Both, the lower unit 40 and the upper unit 130 employ coaxial drives 75, 132 for turning and driving the wheel 110. The coaxial drives 75, 132 are also used to brake the wheel 110. The coaxial drives 75, 132 are generally controlled via manually operable rotational control levers 150, 154; however automated power sources may be utilized. Also disclosed are swivel locks 30 for the caster wheels 20 of the scaffolding unit 11.

B. Scaffolding Unit.

The drive mechanism 10 generally attaches to various types of scaffolding units of various sizes and shapes. In the preferred embodiment, the scaffolding unit 11 has a lower frame 12 that supports an upper frame 26 and adjusts to allow vertical adjustment of the upper frame 26. The lower frame 12 and the upper frame 26 are preferably structured in a stacked embodiment.

The lower frame 12 generally includes a plurality of telescopic corner posts 13 for supporting the upper frame 26 in a parallel orientation with the floor surface. The corner posts 13 vertically adjust via a vertical adjustment unit 19, which may be comprised of a manually operable structure, such as one having a crank, or may be comprised of a powered structure, such as having an electric motor, etc. Each of the corner posts 13 preferably include cross supports or other braces for connecting and stabilizing the corner posts 13 in a vertical orientation.

The lower frame 12 also includes lower supports 15 horizontally oriented at a lower end of the corner posts 13 to further stabilize the lower frame 12. The lower supports 15 generally extend outwards from each corner of the lower frame 12 and include a caster 20 having a wheel 23 attached at each respective end. Each end of the lower frame 12 may also include a ladder having vertical ladder posts 17 and ladder rungs 18 secured in a fixed manner to the corner posts 13 for accessing the work platform 27 of the upper frame 26.

Each caster 20 is generally able to pivot side-to-side relative the lower frame 12 to allow 360 degrees directional movement of the scaffolding unit 11. The casters 20 each include side plates 21 which rotatably support a wheel 23 therebetween. A connecting plate 22 extends across and above the wheel 23 to connect the opposing side plates 21. A brake unit 24 extends from the connecting plate 22 to prevent rotation of the wheel 23 when it is desired to prevent movement of the scaffolding unit 11.

The upper frame 26 generally includes a work platform 27 of various sizes. Extending upward from at least the corners of the work platform 27 are vertical columns 28 that preferably have a hollow and open upper end for receiving the upper retainer 120. The vertical columns 28 also support the horizontal guard rails 29 substantially surrounding the work platform 27.

C. Swivel Lock.

The present invention preferably include a swivel lock 30 in communication with the casters 20 to prevent side-to-side pivotal movement of the wheels 23 thus allowing the operator to more easily direct the scaffolding unit 11 in a straight path. The swivel locks 30 are generally only located upon the rear casters 20 (opposite the end of the scaffolding unit 11 where the lower unit 40 is attached); however it is appreciated that the swivel locks 30 may be located upon the front casters 20 of the scaffolding unit 11.

Each swivel lock 30 is preferably supported at a distal end of the front lower support 15 and is preferably affixed to a lower flange 16 of the lower support 15 or adjacent thereto. In the preferred embodiment, the swivel lock 30 includes a support element 31 affixed to the lower support 15 or lower flange 16 and a pin 32 supported by the support element 31 so that the pin 32 extends transverse to the wheel 23 and parallel to the connecting plate 22 of the caster 20.

A pivotal lock 34 is attached to the pin 32, wherein the lock 34 is able to vertically pivot relative the caster 20. The lock 34 includes a plate 35 and preferably retaining elements 36 extending outwardly from opposing sides near and end of the plate 35 (opposite the pin 32). As the plate 35 is pivoted downwardly towards the connecting plate 22, the retaining elements 36 are positioned upon the outside of the side plates 21 thus preventing side-to-side movement of the side plates 21 and thus wheel 23 secured therebetween. In an alternate embodiment, the retaining elements 36 may extend upwards from the side plates 21 and the plate 35 is pivoted between thereof.

D. Lower Unit.

The lower unit 40 of the drive mechanism 10 is attached to a front end of the scaffolding unit 11; however the lower unit 40 may attached at the rear end if the scaffolding unit 11 is desired to be driven from the rear end. The lower unit 40 generally includes an attachment assembly 41 to removably secure the lower unit 40 to the scaffolding unit 11 and a drive assembly 70 that is operated via the upper unit 130 to move and brake pad 88 the scaffolding unit 11.

The attachment assembly 41 generally allows for a quick, non-tool needed, attachment to the scaffolding unit 11. The attachment assembly 41 preferably includes a vertical support 42 that is positioned adjacent the end of the scaffolding unit 11. Extending from the vertical support 42 are a plurality of retainers 43-46, 49 to receive the lower frame 12 of the scaffolding unit 11. The retainers 43-46, 49 may attach to the cross supports and corner posts 13 of the lower frame 12, or may attach to the ladder rungs 18 and vertical ladder posts 17 (if positioned on the outside of the cross supports), or may attach to various other horizontal and vertical fixtures of the lower frame 12.

The retainers 43-46, 49 preferably includes a hook-shaped upper retainer 43 to receive a horizontal support, such as the ladder rung 18 or cross support, a first side retainer 44 and a second side retainer 45 to receive an adjacent vertical support from both sides, such as the vertical ladder post 17 or corner post 13, and a L-shaped lower retainer 46 to receive a bottom horizontal support, such as the lower support 15 or bottom ladder rung 18.

The attachment assembly 41 also generally includes a tightening mechanism 47 having a knob 48 and a retaining flange 49. The retaining flange 49 is generally comprised of an L-shaped bracket that receives both the vertical ladder post 17 and a corner post 13. As the knob 48 is rotated, the space defined by the retaining flange 49 lessens thus allowing for the attachment assembly 41 to tighten to the lower frame 12 and be secured thereto.

The attachment assembly 41 is secured to the drive assembly 70 in a manner to allow vertical movement of the drive assembly 70 relative the attachment assembly 41. The vertical movement allows the drive assembly 70 to be engaged and disengaged. In an engaged position, the wheel 110 of the drive assembly 70 is lowered to make contact with a floor surface, thus allowing the present invention to be used to move or brake the scaffolding unit 11. In a disengaged position, the wheel 110 and drive assembly 70 is raised relative the attachment assembly 41 to not contact the floor surface thus allowing the scaffolding unit 11 to be moved solely by the wheels 23 of the casters 20.

A pair of upper braces 50 extend from the upper end of the support column and have a collar 51 secured thereto for receiving the tube sections 77 of the outer drive 76 of the coaxial drive 75 of the drive assembly 70 in a manner to allow rotation and vertical movement of the outer drive 76. A first lower brace 52 and a second lower brace 56 secure the coaxial drive 75 at a lower end of the tube section 77, wherein the first lower brace 52 and the second lower brace 56 are pivotally secured on one end to the vertical support 42 and are pivotally secured on an opposing end to a sleeve 71 surrounding the tube section 77 of the outer drive 76 thus allowing rotation of the outer drive 76 relative the sleeve 71.

An engagement unit 60 is utilized to secure the wheel 110 in a raised position. The engagement unit 60 is permanently secured to the second lower brace 56 and is selectively secured to the first lower brace 52. In the preferred embodiment, the engagement unit 60 includes a first support 61 extending vertically upwards from the second lower brace 56. Surrounding the first support 61 is a compression spring 62 which allows for retracting and expanding of the first support 61. When the engagement unit 60 is moved to the disengaged position, the spring 62 retracts the first member 85 and retaining hook 66 to be out of the way of the lower braces 52, 56. A second support 64 pivotally extends from the upper end of the first support 61 and is pivotally connected to the vertical support 42 near the inner end of the first lower brace 52 via some pivotal linkage 65.

A retaining hook 66 having a slot 67 and a tapered top end extends from the interconnection point of the first support 61 and the second support 64. The retaining hook 66 is used to grasp a retaining element 55 extending from the first lower brace 52 when raising the wheel 110 above the floor surface. A release lever 69 is also connected to the retaining hook 66 and when raised pivots the retaining hook 66 backwards to release the retaining hook 66 from the retaining element 55 of the first lower brace 52. The second lower brace 56 may also include a loop member 59 for the operator to grasp to more easily lift the second lower brace 56 and drive assembly 70 when vertically raising the wheel 110 toward the disengagement position.

The drive assembly 70 is secured to the attachment assembly 41 via the loose collar 51 and via the sleeve 71 surrounding the lower portion of the tube section 77 of the outer drive 76. The sleeve 71 includes a first bracket 72 and a second bracket 73 extending therefrom to pivotally receive the first lower brace 52 and the second lower brace 56 thus allowing the outer drive 76 of the drive assembly 70 to vertically move relative the attachment assembly 41 in a parallel relationship.

The tube section 77 of the outer drive 76 is connected to the shroud 90 and mechanically connected to the wheel 110, wherein the outer drive 76 is rotated to rotate the wheel 110. The outer drive 76 also includes a lower coupler 78 extending from the tube section 77 at an upper end to slidably receive an upper coupler 135 of the outer drive 133 of the upper coaxial drive 132 and thus attach the upper unit 130 to the lower unit 40. The lower coupler 78 of the outer drive 76 of the coaxial drive 75 also generally includes a projecting element 79 which receives an opening 92 of a connecting plate 136 of the upper coupler 135 of the coaxial drive 132 of the upper unit 130 to secure the upper unit 130 to the lower unit 40. The tube section 77 is preferably rotatably coupled to the shroud 90 via to allow for the shroud 90 and wheel 110 to turn when the outer drive 76 is rotated.

A hollow flange 80 is preferably located at a lower end of the sleeve 71 adjacent the shroud 90 surrounding the wheel 110. The hollow flange 80 includes a retaining plate 81 therein having a spiraled slot 82 extending therethrough partially encircling the tube section 77. The slot 82 receives a brake unit 84 that is used to brake the rotation of the wheel 110. The brake unit 84 may be operated from upon the work platform 27 of the scaffolding unit 11 via turning the second control 154 to turn the wheel 110 approximately 90 degrees or more. At the end of the spiral slot 82 is preferably a seat 83 which receives a first member 85 of the brake unit 84 and retains the first member 85 therein so that the brake unit 84 may be engaged without needing to continue pressure upon the second operable control 154 and brake unit 84.

The brake unit 84 includes the first member 85 vertically extending through the slot 82 and through an opening 92 extending through the upper plate 91 of the shroud 90. Pivotally extending from the lower end of the first member 85 is a second member 86 via a pivot rod 87. A brake pad 88 extends from the second member 86 to selectively contact the wheel 110. As the wheel 110 is turned, the first member 85 pivots inwardly toward the tube section 77 via the first member 85 traveling within the spiral-structured slot 82. As the first member 85 pivots inwardly, the brake pad 88 pivots downwardly until eventually the brake pad 88 contacts the wheel 110 and provides resistance to brake the rotation of the wheel 110.

The shroud 90 is generally box-shaped and includes an upper plate 91 and side plates 93 having an open bottom for the wheel 110 to extend therethrough. A lower inner drive 100 of the coaxial drive 75 of the lower unit 40 extends through the tube section 77 of the outer drive 76 and within the shroud 90. The inner drive 100 is rotatable within the outer drive 76. At an upper end of the inner drive 100 is an engagement fork 101 which is rotated via rotation of the first operable control 150 of the upper unit 130. At a lower end of the inner drive 100 is preferably a first beveled gear 102. The central portion of the inner drive 100 may be comprised of a cylindrical structure; a pair of rods that rotate together, or various other configurations.

The first beveled gear 102 of the coaxial drive 75 meshes with a second beveled gear 105 that is attached to a sprocket 106 above the wheel 110 within the shroud 90. As the second beveled gear 105 is rotated, the shaft 104 is caused to rotated which in turn rotates the rotationally coupled first sprocket 106. The first sprocket 106 is connected to a second sprocket 113 via an elongated member 108, such as a chain. The second sprocket 113 is rotationally coupled to the wheel 110 via an axle 111. Thus, as the second sprocket 113 is rotated, the wheel 110 is caused to rotate.

E. Upper Retainer.

An upper retainer 120 is used to secure the upper unit 130 relative the upper frame 26 of the scaffolding unit 11. The upper retainer 120 is preferably removably attached to the upper frame 26 of the scaffolding unit 11. In the preferred embodiment, the upper retainer 120 includes a vertical support 121 that is removably received by the respective vertical column 28 of the upper frame 26. A horizontal support 122 extends outwards from the upper end of the vertical support 42 and a first curved receiver 124 and second curved receiver 125 extend outwards from a distal end of the horizontal support 122.

The first curved receiver 124 and the second curved receiver 125 are preferably vertically spaced apart and curve in opposing directions to grasp the top outer tube section 134 of the outer drive 133 of the upper coaxial drive 132 of the upper unit 130 in a removable manner. The first curved receiver 124 and the second curved receiver 125 together extend substantially around the outer section 134 of the coaxial drive 132.

F. Upper Retainer.

The upper unit 130 is removably attached to the lower unit 40 and is used by the operator to control the drive assembly 70 of the lower unit 40 when upon the work platform 27 of the scaffolding unit 11. The upper unit 130 generally includes the coaxial drive 132 having the outer drive 133 and an inner drive 140 rotationally coupled to the coaxial drive 75 of the lower unit 40.

The outer drive 133 of the upper unit 130 includes a plurality of telescopic outer tube sections 134 that vertically adjust with the vertical adjustment of the upper frame 26 relative the lower frame 12. At a lower end of the outer drive 133 is an upper coupler 135 to receive the lower coupler 78. The upper coupler 135 includes a connector plate 136 rotatably attached thereto and including an opening 137 extending through a distal end. The opening 137 removably receives the projecting element 79 of the lower coupler 78 thus securing the lower coupler 78 to the upper coupler 135 in a fixed relationship.

The inner drive 140 of the coaxial drive 132 of the upper unit 130 extends within the tube sections 134 of the outer drive 133 of the coaxial drive 132. The upper inner drive 140 includes an engagement fork 142 at a lower end to mesh with and rotatably couple with the engagement fork 101 of the lower inner drive 100. The central portion of the upper inner drive 140 is also preferably telescopically adjustable with the upper tube sections 134 of the outer drive 133.

The first operable control 150 has the function of rotating the wheel 110 to drive the scaffolding unit 11 in a forward or rearward direction. The first operable control 150 and the second operable control 154 are preferably located at an upper end of the upper unit 130 above a flange 157. The first operable control 150 is preferably rotationally coupled to the inner drive 140. The first operable control 150 also generally includes a handle 151. When the first operable control 150 is rotated relative the outer drive 133, the inner drive 140 is caused to rotate which rotates the lower inner drive 100 and subsequently rotates the wheel 110 via the beveled gears 102, 105 and sprockets 106, 113 and chain 108. The wheel 110 may be rotated in a forward direction or a reverse direction via simply rotating the first operable control 150 in a different direction.

The second operable control 154 has the function of turning the wheel 110 left or right. The second operable control 154 extends horizontally outwards and is rotationally coupled to the upper tube sections 134 of the outer drive 133. As the second operable control 154 is rotated, the upper tube sections 134 rotate, thus causing the lower tube section 77 to rotate and the shroud 90 to rotate which causes the wheel 110 to turn. Along with turning the wheel 110 the second operable control 154 may serve the function of braking the wheel 110, wherein the brake unit 84 is engaged when the wheel 110 is turned substantially, such as more than 90 degrees. It is appreciated that motorized operable controls may be utilized to rotate the wheel 110 and turn the wheel 110 in similar manners, such as a motor near the wheel 110 controlled via a remote from the working platform 27.

G. Operation of Preferred Embodiment.

In use, after the lower unit 40 and the upper unit 130 are secured to each other and the scaffolding unit 11, the wheel 110 is lowered to the floor surface. The release lever 69 is raised which causes the retainer hook 66 to move backwards and release from the retaining element 55 of the first lower brace 52. The first lower brace 52 and the second lower brace 56 are able to pivot downwards which also allows the drive assembly 70 to move downwards until the wheel 110 engages the floor surface. The swivel locks 30 may also be engaged on the appropriate casters 20 if desired to prevent side-to-side movement of certain casters 20.

The operator climbs upon the work platform 27 of the scaffolding unit 11. The upper frame 26 and work platform 27 may be raised to a desired height. As the upper frame 26 is raised, the curved receivers 124, 125 of the upper retainer 120 lift upon the flange 157 of the upper unit 130 to cause the telescopic upper coaxial drive 132 to extend and be lifted with the upper frame 26 as the lower frame 12 is retained in position with the wheel 110 contacting the floor surface.

As the first operable control 150 is rotated, the wheel 110 is caused to rotate in a respective forward or backward direction. As the second operable control 154 is rotated, the wheel 110 turns in a respective left or right direction. The first operable control 150 and the second operable control 154 may be operated simultaneously or separately. The second operable control 154 may be rotated to an extreme position to cause the brake unit 84 to move into the seat 83 and engage to brake a rotation of the wheel 110 as the operator desires to stop movement of the scaffolding unit 11, wherein the friction of the wheel 110 against the floor surface prevents the scaffolding unit 11 from moving as long as the wheel 110 is retained in a fixed rotational position.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A mobile tower drive system, comprising:

a lower unit adapted to be secured to a lower end of a scaffolding unit, wherein said lower unit has a wheel to operably engage a floor surface;

wherein said lower unit has a lower drive having a lower inner drive and a lower outer drive; and an upper unit removably connected to said lower unit, wherein said upper unit is adapted to be secured to an upper end of a scaffolding unit and controlled from thereof;

wherein said upper unit has an upper drive having an upper inner drive rotationally coupled to said lower inner drive and an upper outer drive rotationally coupled to said lower outer drive;

wherein said upper unit includes a first control rotationally coupled to said upper inner drive and adapted to control a rotation of said wheel via rotation of said lower inner drive;

wherein said upper unit includes a second control rotationally coupled to said upper outer drive and adapted to control a turning of said wheel via rotation of said lower outer drive.

2. The mobile tower drive system of claim 1, wherein said upper unit vertically adjusts in a telescopic manner.

3. The mobile tower drive system of claim 2, wherein said upper drive of said upper unit telescopically adjusts.

4. The mobile tower drive system of claim 1, wherein said lower inner drive includes a lower engagement fork at an upper end and wherein said upper inner drive includes an upper engagement fork at a lower end, wherein said lower engagement fork rotationally couples to said upper engagement fork.

5. The mobile tower drive system of claim 1, wherein said lower outer drive includes a lower coupler at an upper end and wherein said upper outer drive includes an upper coupler at a lower end, wherein said lower coupler rotationally couples to said upper coupler in a tubular manner.

6. The mobile tower drive system of claim 1, wherein said lower unit includes:

a shroud partially encasing said wheel, wherein said shroud includes an axle for supporting said wheel and wherein said lower inner drive extends within said shroud;

a first beveled gear extending from said lower inner drive within said shroud;

a shaft extending within said shroud above said wheel;

a second beveled gear coupled to said shaft, wherein said second beveled gear meshes with said first beveled gear to rotate said shaft;

a first sprocket rotationally coupled to said shaft and rotated by said shaft via said rotation of said second beveled gear;

a second sprocket rotationally coupled to said axle; and a chain interconnecting said first sprocket and said second sprocket to transfer a rotational movement of said inner drive assembly to said wheel.

7. The mobile tower drive system of claim 6, wherein said lower outer drive is rotationally coupled to said shroud so that a rotation of said lower outer drive causes said shroud and said wheel to rotate in a side-to-side manner.

8. The mobile tower drive system of claim 1, including a brake unit to brake a rotation of said wheel, wherein said brake unit is operably connected to said second control.

9. The mobile tower drive system of claim 8, wherein said lower unit has an inwardly spiraling slot in communication with said brake unit, wherein a rotation of said lower outer drive causes said brake unit to travel within said slot and brake said wheel.

10. The mobile tower drive system of claim 1, wherein said first control is independently operable relative said second control.

11. A mobile tower drive system, comprising:

a scaffolding unit having a lower frame and a stacked upper frame;

wherein said lower frame includes a plurality of vertical posts, a plurality of horizontal posts interconnecting said plurality of vertical posts, and a plurality of caster wheels in communication with a floor surface for movement of said lower frame;

wherein said upper frame has a working platform and a series of guide rails at least partially surrounding said working platform;

a lower unit having an attachment assembly and a drive assembly;

wherein said attachment assembly is removably attached to said lower frame;

wherein said drive assembly includes a wheel and wherein said drive assembly is supported in an upright position via said attachment assembly;

wherein said lower unit includes an engagement unit to vertically adjust said drive assembly to a disengaged position where said wheel is not in contact with a floor surface and an engaged position where said wheel is in contact with a floor surface;

an upper retainer adapted to removably attach to said upper frame; and an upper unit operably and removably attached to the lower unit and adapted to be secured to said upper retainer at said upper frame of said scaffolding unit;

wherein said upper unit includes a plurality of controls operably connected to said drive assembly and adapted to control a turning function, a forward moving function, a rearward moving function, and a braking function of said wheel of said drive assembly;

wherein said plurality of controls are operable from said working platform of said upper frame;

wherein said lower unit includes a plurality of pivotally connected braces connecting said attachment assembly to said drive assembly, wherein said braces maintain a parallel orientation of said drive assembly with said attachment assembly during said engaged position and said disengaged position.

12. The mobile tower drive system of claim 11, wherein said engagement unit interconnects said plurality of pivotally connected braces.

13. The mobile tower drive system of claim 11, wherein at least one caster wheel of said plurality of caster wheels includes a swivel lock to prevent a side-to-side movement of said at least one caster wheel.

14. The mobile tower drive system of claim 11, wherein said plurality of controls are operably connected to said wheel via a drive.

15. The mobile tower drive system of claim 14, wherein said plurality of controls are independently operably connected to said wheel via said drive.

16. The mobile tower drive system of claim 11, wherein said upper unit telescopically adjusts in height.

17. The mobile tower drive system of claim 11, wherein said engagement unit is spring-loaded.

18. The mobile tower drive system of claim 11, wherein said plurality of controls are rotationally coupled to said upper unit and said lower unit.

19. A mobile tower drive system, comprising:

a scaffolding unit having a lower frame and a stacked upper frame;

wherein said lower frame includes a plurality of vertical posts, a plurality of horizontal posts interconnecting said plurality of vertical posts, and a plurality of caster wheels in communication with a floor surface for movement of said lower frame;

wherein at least one caster wheel of said plurality of caster wheels includes a swivel lock to prevent a side-to-side movement of said at least one caster wheel;

wherein said upper frame has a working platform and a series of guide rails at least partially surrounding said working platform;

a lower unit having an attachment assembly and a drive assembly;

wherein said attachment assembly is removably attached to said lower frame;

wherein said drive assembly includes a wheel and wherein said drive assembly is supported in an upright position via said attachment assembly;

wherein said drive assembly has a lower drive having a lower inner drive and a lower outer drive;

wherein said lower unit includes an engagement unit to vertically adjust said drive assembly to a disengaged position where said wheel is not in contact with a floor surface and an engaged position where said wheel is in contact with a floor surface;

wherein said lower unit includes a plurality of pivotally connected braces connecting said attachment assembly to said drive assembly, wherein said braces maintain a parallel orientation of said drive assembly with said attachment assembly during said engaged position and said disengaged position;

wherein said engagement unit interconnects said plurality of pivotally connected braces and wherein said engagement unit is spring-loaded;

an upper retainer adapted to removably attach to said upper frame;

an upper unit operably and removably attached to the lower unit and adapted to be secured to said upper retainer at said upper frame of said scaffolding unit;

wherein said upper unit has an upper drive having an upper inner drive rotationally coupled to said lower inner drive and an upper outer drive rotationally coupled to said lower outer drive;

wherein said upper drive of said upper unit telescopically adjusts;

wherein said lower inner drive includes a lower engagement fork at an upper end and wherein said upper inner drive includes an upper engagement fork at a lower end, wherein said lower engagement fork rotationally couples to said upper engagement fork;

wherein said lower outer drive includes a lower coupler at an upper end and wherein said upper outer drive includes an upper coupler at a lower end, wherein said lower coupler rotationally couples to said upper coupler in a tubular manner;

wherein said lower unit includes a shroud partially encasing said wheel, wherein said shroud includes an axle for supporting said wheel and wherein said lower inner drive extends within said shroud;

wherein said lower unit includes a first beveled gear extending from said lower inner drive within said shroud;

wherein said lower unit includes a shaft extending within said shroud above said wheel;

wherein said lower unit includes a second beveled gear coupled to said shaft, wherein said second beveled gear meshes with said first beveled gear to rotate said shaft;

wherein said lower unit includes a first sprocket rotationally coupled to said shaft and rotated by said shaft via said rotation of said second beveled gear;

wherein said lower unit includes a second sprocket rotationally coupled to said axle;

wherein said lower unit includes a chain interconnecting said first sprocket and said second sprocket to transfer a rotational movement of said inner drive assembly to said wheel;

wherein said lower outer drive is rotationally coupled to said shroud so that a rotation of said lower outer drive causes said shroud and said wheel to rotate in a side-to-side manner;

wherein said upper unit includes a first control rotationally coupled to said upper inner drive and adapted to control a rotation of said wheel via rotation of said lower inner drive;

wherein said upper unit includes a second control rotationally coupled to said upper outer drive and adapted to control a turning of said wheel via rotation of said lower outer drive;

wherein said first control and said second control are operable from said working platform of said upper frame; and a brake unit to brake a rotation of said wheel, wherein said brake unit is operably connected to said second control;

wherein said lower unit has an inwardly spiraling slot in communication with said brake unit, wherein a rotation of said lower outer drive causes said brake unit to travel within said slot and brake said wheel;

wherein said first control is independently operable relative said second control.

* * * * *